United States Patent [19]

Streit et al.

[11] Patent Number: 4,622,037

[45] Date of Patent: Nov. 11, 1986

[54] BLEACHING COTTON-CONTAINING FABRICS WITH HYPOCHLORITE AT ELEVATED TEMPERATURES

[75] Inventors: Werner Streit, Bobenheim; Dieter Bassing, Ludwigshafen; Karlheinz Gebert, Heddesheim; Friedrich Klippel, Ludwigshafen; Norbert Leppert, Speyer, all of Fed. Rep. of Germany

[73] Assignee: BASF Aktiengesellschaft, Rheinland-Pfalz, Fed. Rep. of Germany

[21] Appl. No.: 730,095

[22] Filed: May 3, 1985

[30] Foreign Application Priority Data

May 16, 1984 [DE] Fed. Rep. of Germany ..... 3418109

[51] Int. Cl.[4] ..... D06L 3/06

[52] U.S. Cl. ..... 8/108.1; 8/101

[58] Field of Search ..... 8/108 A, 101; 252/95, 252/99, 186

[56] References Cited

U.S. PATENT DOCUMENTS 3,528,921 9/1970 Gray ..... 252/99

4,390,448 6/1983 Boden et al. ..... 8/108 A

FOREIGN PATENT DOCUMENTS 1548379 7/1979 United Kingdom .

OTHER PUBLICATIONS

"Manual of Textile Assistants" by Chwala/Angeri, Verlag Chemie, Weinheim-New York 1977, pp. 343-344.

"Chemical Technology of Textiles", Springer Verlag, Berlin, Gottingen, Heidelberg, 1963, pp. 65-77.

*Primary Examiner*—Paul Lieberman
*Assistant Examiner*—John F. McNally
*Attorney, Agent, or Firm*—Oblon, Fisher, Spivak, McClelland & Maier

[57] ABSTRACT

Cotton-containing fabrics are bleached with hypochlorite in an aqueous alkaline liquor at elevated temperatures by a process in which bleaching is carried out at from 80° to 110° C. in the course of from 30 seconds to 25 minutes in the presence of a water-soluble polyhydroxy compound, as a readily oxidizable substance, in an amount of from 0.5 to 20 g/l.

7 Claims, No Drawings

BLEACHING COTTON-CONTAINING FABRICS WITH HYPOCHLORITE AT ELEVATED TEMPERATURES

In the textile industry, cotton fabric and cotton-containing blends are bleached predominantly with hydrogen peroxide or hypochlorite. In certain circumstances, the two bleaching processes are employed in succession.

Bleaching with hypochlorite is carried out, as a rule, at room temperature, ie. from 20° to 25° C., and a pH of from 9.5 to 12. The duration of the treatment varies from about 20 minutes to several hours, depending on the amount of active chlorine employed.

The skilled worker is familiar with the fact that hypochlorite damages cotton fibers to a lesser or greater extent depending on the conditions. For example, it is clear from the Manual of Textile Assistants by Chwala-/Angerer, Verlag Chemie, Weinheim-New York, 1977, pages 343–344, that the industrial bleaching of textiles with sodium hypochlorite has to be carried out at no higher than 35° C. and a pH of from 9.5 to 12 in order to keep the damage to the fibers at a very low level. Although increasing the temperature by 10° C. doubles the bleaching rate, it also results in greater damage to the fibers.

It is also stated that, for white cotton goods, bleaching with hypochlorite can be combined with subsequent bleaching with hydrogen peroxide in order to obtain a particular whiteness and high absorptivity. The alkaline peroxide solution first removes the residual hypochlorous acid by reduction, and the chloramines formed from substances accompanying the cotton, and then develops its actual bleaching action. In this procedure, fiber-protecting agents are absolutely essential.

Stringent monitoring of the bleaching conditions to achieve satisfactory bleaching with chlorine (ie. pH of from 9 to 11.5, temperature of the bleach baths no higher than 20° C., continuous checking of the alkali content and of the amount of bleaching agent consumed) is also recommended in the Textbook of Textile Chemistry Including Chemical Technology of Textiles, Springer Verlag, Berlin, Göttingen, Heidelberg, 1963, pages 65–77.

Our own experiments have shown that desized cotton fabric can be readily bleached at a pH of from 10 to 13 obtained with sodium carbonate, in a short-term reaction lasting from about 30 seconds to 20 minutes at from 90° to 105° C., but, similarly to the prior art, this procedure results in substantial damage to the fibers, as is shown by a greatly reduced DP value (mean degree of polymerization of the cellulose molecules of the cotton).

It is an object of the present invention to provide a bleaching process which employs hypochlorite and can be carried out at elevated temperatures.

We have found that this object is achieved by a process for bleaching cotton-containing fabrics with hypochlorite in an aqueous alkaline liquor at elevated temperatures, wherein bleaching is carried out at from 80° to 110° C. in the course of from 30 seconds to 25 minutes in the presence of a water-soluble polyhydroxy compound, as a readily oxidizable substance, in an amount of from 0.5 to 20 g/l.

The essential feature of the invention is the combination of hypochlorite or a hypochlorite donor with a readily oxidizable substance, and the unforseeable effect is, in particular, the fact that the alkali concentrations used, eg. from 8 to 60 g/l of sodium hydroxide, can be higher than those employed to date without the fibers being damaged or the bleaching effect lost.

For the purposes of the present invention, cotton-containing fabric comprises pure cotton and, in particular, polyester blends containing not less than 20% of cotton. The corresponding yarns are of course also included.

The hypochlorites used are alkali metal hypochlorites, in particular sodium hypochlorite, and hypochlorite donors, such as dichloro- and trichloroisocyanurates. The bleaching liquors contain from 1 to 8, preferably from 2 to 6, g of active chlorine per liter, or the amount which can liberate this amount of active chlorine.

The alkaline aqueous liquors used in the novel bleaching process advantageously have a pH of not less than 10.

This pH is advantageously established by adding an alkali metal hydroxide, in particular sodium hydroxide, as a rule in an amount of from 8 to 60, preferably from 10 to 25, g/l. In addition, the liquors can, if required, contain from 5 to 15 g/l of an alkali metal carbonate, preferably sodium carbonate.

As a rule, the total liquor is advantageously about 100% by weight, based on the weight of the fabric.

The particular characteristic feature of the novel process is that it is carried out at from 80° to 110° C., preferably from 90° to 103° C. Another particular characteristic feature is that the bleaching process is effected in the presence of a water-soluble polyhydroxy compound which is stable to hypochlorite at low temperatures and at room temperature and is readily oxidizable at elevated temperatures, ie. reacts more rapidly with the hypochlorite than the latter reacts with the cellulose units of the cotton.

Compounds which are very suitable for this purpose are polyhydroxy compounds possessing an α-hydroxycarbonyl group from the series consisting of the mono-, di- and oligosaccharides and the series consisting of the α-hydroxycarboxylic acids and their derivatives.

Specific examples are sucrose, lactose, maltose, glucose, pentose, galactose, mannose, arabinose, sorbose, and erythrose, as well as hydroxyacetone, glucose 6-phosphate, gluconic acid, gluconolactone, glucoheptonic acid and ascorbic acid.

Polyols, such as mannitol, sorbitol, glucitol, glycerol and polyglycerol, and mucochloric acid can also be used.

Particularly preferred polyhydroxy compounds used according to the invention are glucose, sucrose and hydroxyacetone.

The polyhydroxy compounds are added to the bleaching liquors in an amount of from 0.5 to 20, preferably from 1.5 to 10, g/l.

The term readily oxidizable is intended to embrace those compounds which can be classified as being relatively stable to hypochlorite at low temperatures and having a redox potential which increases with increasing alkali concentration and increasing temperature. Only as a result of this interplay is it possible to employ the temperature range according to the invention, a range which to date has been inaccessible for an industrial textile bleaching process.

A particularly noteworthy advantage is that the active chlorine has a very short half-life in the bleaching process according to the invention. As a rule, in the temperature range according to the invention, all active chlorine has been consumed after one minute, and none is detectable even on the fabric.

Accordingly, the novel process is advantageously carried out in the course of from 30 seconds to 25 minutes, preferably from 1 to 5 minutes.

The short half-life has the advantage over a peroxide bleaching procedure that no damage to the fabric can occur as a result of a prolonged oxidation period, for example when the machine is not operating, the expense of stabilizing measures, as are usual in the case of peroxides, is no longer incurred, and the substantially lower sensitivity to heavy metal impurities is noteworthy.

Otherwise, the conditions to be maintained for the novel process are familiar to the skilled worker.

Advantageous apparatuses for the procedure are the conventional steaming units.

Suitable additives for the bleaching liquors are the conventional ones, eg. surfactants as wetting agents and detergents, these advantageously being added in an amount of from 3.0 to 10 g/l. Particular examples of these surfactants are alkylphenol oxyethylates having from 5 to 10 ethylene oxide units and fatty alcohol oxyethylates with about the same degree of oxyethylation.

Other additives are, for example, sequestering agents, which are stable to oxidation because of the hardness of the water and which are also capable of increasing the whiteness. Hydroxyethanediphosphonic acid is particularly useful for this purpose.

EXAMPLES

In all of the Examples, the pieces of fabric were enzymatically desized and then thoroughly washed. The next pretreatment step was an alkaline scouring procedure under the following conditions: 40 g/l of NaOH, 10 g/l of a scouring assistant, 100% wet pick-up, time and temperature: 10 minutes at 100° C.

The pieces of fabric were then impregnated with bleaching liquor and squeezed out to a wet pick-up of 100%.

After the bleaching reaction in a hot unit, they were washed out with water twice at 95° C., for 2 minutes each time, and twice at 35° C., for 2 minutes each time.

EXAMPLE 1

50:50 polyester/cotton fabric, desized and scoured, and having a Tegewa value of from 7 to 8, a whiteness of 71.5 (Elrepho units) and a DP value of 2100.

Bleaching liquor: 10 g/l of sodium hydroxide, 5 g/l of surfactant and 2.5 g/l of active chlorine in the form of sodium hypochlorite.

Treatment time: 2 minutes at 100° C.

Result:

| Additive g/l | — | 2.5 glucose | 5.0 sucrose |
|---|---|---|---|
| Whiteness | 82.9 | 81.9 | 81.7 |
| DP value | 1610 | 2060 | 2000 |

Desized gray cotton cloth having a Tegewa value of 9, a whiteness of 67.5 and a DP value of 2050.

Bleaching liquor: 10 g/l of sodium hydroxide, 5 g/l of surfactant and 3.0 g/l of active chlorine in the form of dichloroisocyanate.

Treatment time: 2 minutes at 103° C.

Result:

| Additive g/l | — | 2.0 glucose | 4.0 glucose |
|---|---|---|---|
| DP value | 1260 | 1860 | 1790 |
| Whiteness | 86.1 | 85.9 | 84.2 |

Desized and scoured cotton twill having a Tegewa value of 8, a whiteness of 69.0 and a DP value of 2410.

Bleaching liquor as described in Example 2, containing 3 g/l of active chlorine in the form of trichloroisocyanurate.

Treatment time: 3 minutes at 100° C.

Result:

| Additive g/l | — | 4.0 glucose |
|---|---|---|
| Whiteness | 86.8 | 85.3 |
| DP value | 1080 | 1790 |

EXAMPLE 4

Cotton poplin shirting, desized (Tegewa value 7–8) and scoured, and having a whiteness of 70.5 and a DP value of 2500.

Bleaching liquor: 8.5 g/l of NaOH, 5 g/l of surfactant, 2.5 g/l of active chlorine in the form of sodium hypochlorite and 3.5 g/l of glucose.

(a) Treatment time: 3 minutes at 102° C.

Result:

Whiteness: 82.8

DP value: 2120

(b) Treatment time: 10 minutes at 102° C.

Result:

Whiteness: 82.0

DP value: 2080

EXAMPLE 5

Cotton raincoat poplin, desized (Tegewa value 6–7) and scoured, and having a whiteness of 68 and a DP value of 2220.

Bleaching liquor: 15 g/l of NaOH, 7 g/l of surfactant, 4 g/l of active chlorine in the form of sodium hypochlorite and 6 g/l of maltose.

Treatment time: 90 seconds at 103° C.

Result:

Whiteness: 80.5

DP value: 1890

EXAMPLE 6

Gray cotton cloth, desized (Tegewa value 7) and scoured, and having a whiteness of 69 and a DP value of 2320.

Bleaching liquor: 10 g/l of NaOH, 7 g/l of surfactant and 3 g/l of active chlorine in the form of sodium hypochlorite.

Treatment time: 1 minute at 101° C.

Result:

| Additive g/l | 0 | 2.0 hydroxy-acetone | 2.0 ascorbic acid | 1.5 muco-chloric acid |
|---|---|---|---|---|
| Whiteness | 83.1 | 80.8 | 81.3 | 79.2 |
| DP value | 1270 | 1780 | 1850 | 1760 |

The numerical data obtained show that hot bleaching according to the invention with hypochlorite gives excellent results in terms of increasing the whiteness. Damage to the fiber, expressed in terms of the decrease in the DP value, is similar to that known in the case of peroxide bleaches. The DP values in the comparative experiments without the addition of a polyhydroxy compound confirm that there is substantial damage to the fiber, which cannot be accepted in practice.

We claim:

1. A process for bleaching cotton or a cotton-containing fabric, which comprises bleaching said cotton or cotton-containing fabric with an alkali metal hypochlorite or a hypochlorite donor selected from the group consisting of dichloro- and trichloroisocyanurates in an aqueous alkaline liquor at a temperature in the range of 80°–110° C. in a course of from 30 seconds to 25 minutes in the presence of a water-soluble compound selected from the group consisting of mono-, di-, and oligosaccharides, hydroxyacetone and alpha-hydroxycarboxylic acids and derivatives thereof, as a readily oxidizable substance, in an amount of from 0.5 to 20 grams per liter, and wherein said hypochlorite or hypochlorite donor is used in such an amount that from about 1 to 8 grams of active chlorine per liter is liberated.

2. The process as claimed in claim 1, wherein the water soluble compound added is glucose, sucrose or hydroxyacetone.

3. The process as claimed in claim 1, wherein said water-soluble, readily oxidizable compound is selected from the group consisting of sucrose, lactose, maltose, glucose, pentose, galactose, mannose, arabinose, sorbose, erythrose, glucose 6-phosphate and hydroxyacetone.

4. The process as claimed in claim 1, wherein said alpha-hydroxycarboxylic acid is selected from the group consisting of gluconic acid, glucolactone, glucoheptonic acid and ascorbic acid.

5. The process as claimed in claim 1, wherein the bleaching is carried out at from 90°–103° C.

6. The process as claimed in claim 1, wherein the bleaching is carried out in the course of from 1–5 minutes.

7. The process as claimed in claim 1, wherein the readily oxidizable substrates are used in an amount of from 1.5 to 10 grams per liter.

* * * * *